United States Patent [19]

Wormser

[11] 4,003,691

[45] Jan. 18, 1977

[54] RECIRCULATING BURNER

[75] Inventor: Alex F. Wormser, Marblehead, Mass.

[73] Assignee: Consolidated Natural Gas Service Co., Inc., Pittsburgh, Pa.

[22] Filed: Aug. 22, 1975

[21] Appl. No.: 606,841

[52] U.S. Cl. ..... 431/116; 431/215

[51] Int. Cl.[2] ..... F23L 7/00

[58] Field of Search ..... 431/115, 116, 9, 215, 431/11; 432/21

[56] References Cited

UNITED STATES PATENTS

| | | | |
|---|---|---|---|
| 1,839,512 | 1/1932 | Waterman | 431/115 |
| 3,620,657 | 11/1971 | Robinson | 431/9 |
| 3,652,194 | 3/1972 | Bailey | 431/9 |
| 3,705,784 | 12/1972 | Reichhelm | 431/116 |

*Primary Examiner*—Edward G. Favors

[57] ABSTRACT

A burner for burning a vaporizable liquid fuel comprising a cylindrical combustion chamber, the combustion chamber having an inlet and an outlet, a cylindrical vaporizing chamber, the vaporizing chamber having an inlet and an outlet, a first passage interconnecting the combustion chamber with the vaporizing chamber and serving as a mixing chamber, a second passage interconnecting the combustion chamber toward the combustion chamber outlet with the vaporizing chamber, for carrying hot combustion gases from the combustion chamber into the vaporizing chamber, a vaporizable liquid fuel inlet atomizer positioned along the axis of the vaporizing chamber to direct atomized liquid fuel thereinto, for vaporization therein of the fuel by the hot combustion gases, the atomizer being effected to support vaporization of the fuel before the same touches a wall, an air inlet at the interface of the first passage and the vaporizing chamber outlet, positioned to direct air under pressure through the first passage into the combustion chamber, the second passage, the vaporizing chamber, and the first passage together defining a recirculation path, the path having sufficient width to maintain blue-flame combustion, the vaporized fuel and hot gases being drawn by suction created by the air inlet into the first passage, where they are mixed with air entering from the air inlet to provide a combustible mixture for burning in the combustion chamber.

2 Claims, 3 Drawing Figures

FIG 1
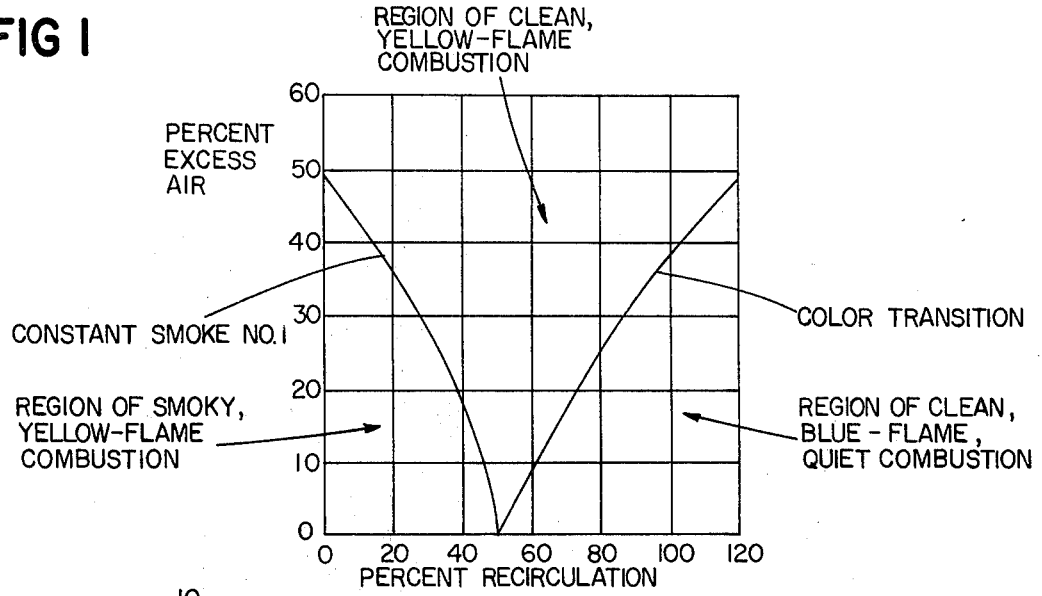
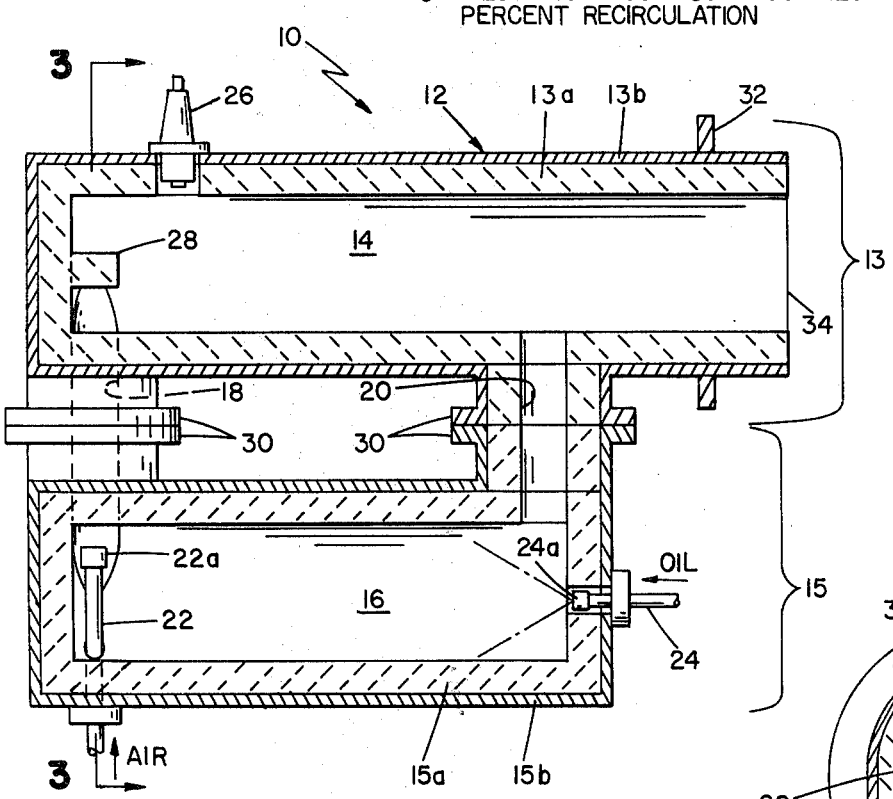
FIG 2
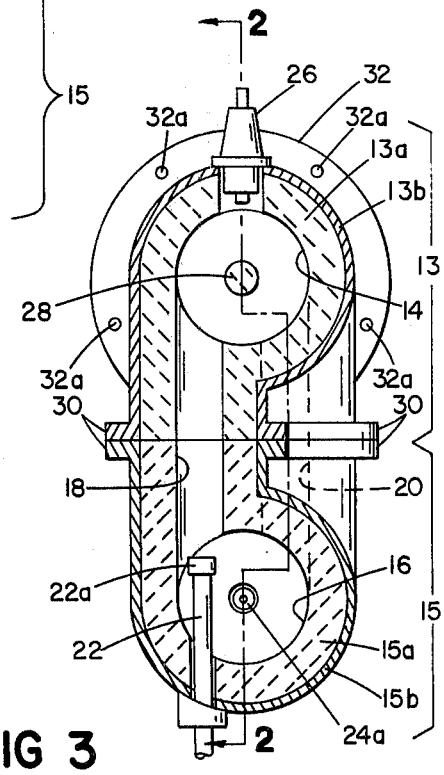
FIG 3

RECIRCULATING BURNER

BACKGROUND OF THE INVENTION

This invention relates to recirculating liquid fuel burners.

It is known to use recirculated hot combustion gases to vaporize liquid fuel, such as oil, for blue-flame, smoke-free, and quiet combustion. It has been said that the percent recirculation should be at least 50%, for maintaining blue-flame combustion, but that the percent recirculation necessary increases with the percent excess air used. American Petroleum Institute Publication 1723-A, January, 1965, pp. 2–4, esp. FIG. 1. "Blue-flame combustion", as the term is used hereinafter, will refer to the "Region of clean, blue-flame, quiet combustion" labeled on FIG. 1 of this API publication, reprinted herein as FIG. 1. Reichhelm et al. U.S. Pat. No. 3,705,784 and Reichhelm U.S. Pat. No. 3,361,183 teach introducing liquid oil into the flow of recirculated hot gases, the driving force for recirculation being provided by suction owing to ejector action by incoming air, although the former patent specifies recirculation of only a small portion of the gases. Von Linde U.S. Pat. No. 3,174,526 teaches spraying atomized liquid fuel into recirculated hot combustion gases in a prechamber slightly upstream of the sites for mixing with air and burning. Thermal Research & Engineering Corp. of Conshohocken, Pennsylvania, offers an internally recirculating burner utilizing tangential entry of inlet air to create a vortex to draw back the hot combustion gases (Bulletin No. 143, pp. 6–7). Complete vaporization of the oil is desired to attain blue-flame combustion.

SUMMARY OF THE INVENTION

The invention provides a safe, clean, simple, sturdy, compact, easy-to-assemble and install, convenient-to-use, and versatile recirculating liquid fuel burner capable of producing blue-flame, smoke-free, and quiet combustion.

The burner can also easily burn gaseous fuels, such as natural gas. There are few parts making up the burner apparatus. Vaporization of the liquid fuel is complete, unwanted condensation of the fuel along the burner walls is prevented, and combustion is thereby made more efficient. Start-up is efficient, without waste of oil, and does not require complex or cumbersome starting equipment. High flame temperatures can be achieved for a variety of industrial applications, such as forging and glass melting.

The invention features a burner for burning a vaporizable liquid fuel comprising a housing, a combustion chamber in the housing, the combustion chamber having an inlet and an outlet, a vaporizing chamber in the housing, the vaporizing chamber having an inlet and an outlet, a first passage interconnecting the combustion chamber inlet with the vaporizing chamber outlet, the first passage serving as a mixing chamber, a second passage interconnecting the combustion chamber toward the combustion chamber outlet with the vaporizing chamber inlet, for carrying hot combustion gases from the combustion chamber into the vaporizing chamber, a vaporizable liquid fuel inlet atomizer connected to the vaporizing chamber and positioned to direct atomized liquid fuel into the vaporizing chamber, the atomizer being effective to support vaporization of the fuel before the same touches a wall, an air inlet at the interface of the first passage and the vaporizing chamber outlet, positioned to direct air under pressure through the first passage and combustion chamber inlet into the combustion chamber, the second passage, the vaporizing chamber, and the first passage together defining a recirculation path for hot combustion gases from the combustion chamber back to the combustion chamber inlet, the path having sufficient width to provide in conjunction with the air inlet enough recirculation to maintain blue-flame combustion, the hot gases being drawn by suction created by the air inlet into the vaporizing chamber, and the vaporized fuel and hot gases being drawn by the same suction into the first passage, where they are mixed with air entering from the air inlet to provide a combustible mixture, the mixture entering the combustion chamber through the combustion chamber inlet for burning in the combustion chamber. In a preferred embodiment the combustion chamber is cylindrical, the first passage enters the combustion chamber tangentially thereto, through the combustion chamber inlet, the second passage connects tangentially with the combustion chamber, the vaporizing chamber is cylindrical, the second passage enters the vaporizing chamber tangentially through the vaporizing chamber inlet, the fuel inlet atomizer is directed into the cylindrical vaporizing chamber along the axis thereof, and the air inlet and fuel inlet atomizer include nozzles.

Other advantages and features of the invention will be apparent from the description and drawings herein of a preferred embodiment thereof.

BRIEF DESCRIPTION OF THE DRAWINGS

FIG. 1 is a graph showing oil burner operating characteristics as a function of percent recirculation and percent excess air.

FIG. 2 is a side view, in cross section, of one embodiment of the invention; and FIG. 3 is a view through 3—3 of FIG. 2.

DESCRIPTION OF THE PREFERRED EMBODIMENT

There is shown in FIG. 2 burner 10, comprising housing 12, which contains cylindrical combustion chamber 14, cylindrical vaporizing chamber 16, and passages 18 and 20, passage 18 interconnecting the inlet of combustion chamber 14 with the outlet of vaporizing chamber 16 and passage 20 interconnecting combustion chamber 14 toward its outlet with the inlet of vaporizing chamber 16. Passage 18 enters combustion chamber 14 tangentially thereto, and passage 20 leaves combustion chamber 14 from the side opposite to that at which passage 18 enters it (FIG. 3), and enters vaporizing chamber 16 tangentially thereto. Air inlet 22 having ejector nozzle **22*a* is positioned to enter vaporizing chamber 16 adjacent the outlet thereof and tangentially thereto, directing air under pressure into passage 18, passage 18 serving as a mixing chamber, as will be explained hereinafter. Oil inlet 24 having nozzle 24*a* is positioned along the axis of vaporizing chamber 16 adjacent the tangential entry of passage 20. Housing 12 comprises burner section 13 and recirculation section 15, the sections being composed, respectively, of inner refractories 13*a* and 15*a* of 3000° F. heat-resistant concrete and outer metal piping 13*b* and 15*b*. Sections 13 and 15 are held together by bolts (not shown) between flanges 30, the two sections together completing passages 18 and 20. Burner 10 is mounted on a furnace, boiler or other heating receptacle by means of flange 32 surrounding and spaced inward from the combustion chamber outlet 34. Outlet 34 is inserted into a hole in the furnace wall (not shown), and flange 32 is bolted to the furnace wall through flange holes 32***a*. Industrial spark plug 26 positioned opposite and slightly downstream of the entrance of passage 18 into combustion chamber 14 provides ignition at start-up. Section 15 can be demounted from section 13 by removal of bolts from flanges 30, if prolonged use of gaseous fuel is desired, making section 15 unnecessary. The upper half of passage 20 is then blocked by a cover bolted to upper flange 30, and air and gaseous fuel enter through the upper half of passage 18 for use of the burner in the gas mode.

Passage 20 carries hot burned gases from chamber 14 down to chamber 16. Oil inlet 24 carries liquid oil from an oil source into nozzle 24*a*. Nozzle 24*a* atomizes the liquid fuel into a fine spray in the form of a cone. Hot gases from passage 20 enter vaporizing chamber 16, and swirl about the cone of spray to evaporate the fuel oil before its particles touch a wall.

Air inlet nozzle 22*a* drives air under pressure into passage 18, creating a suction in passage 18, which suction serves to draw the gaseous contents of vaporizing chamber 16 through passage 18 into combustion chamber 14. In combustion chamber 14, cylindrical projection 28 extending inwardly along the axis of cylindrical chamber 14 acts as a flameholder for burning gases in the chamber.

Operation in the start-up and full-running modes will now be described. In start-up, oil in atomized form is admitted into burner 10 through nozzle 24*a*, and is drawn by the suction from air passing from nozzle 22*a* into passage 18, where the atomized oil is mixed with the incoming air, to provide a combustible mixture. The mixture enters combustion chamber 14 tangentially thereto, and is ignited by spark plug 26. Combustion occurs in chamber 14, with projection 28 providing flameholding. Burning is in the form of a swirl of burning gases, and passage 20 is arranged tangentially at the opposite side of chamber 14 from passage 18 so that passage 20 will receive a portion of the swirling gases and convey them downward to chamber 16.

In full operation, part of the swirling gaseous products of combustion leaves burner 10 through outlet 34, but part is drawn into passage 20 by the suction created by air nozzle 22*a*, nozzle 22*a* and passage 18 together acting as a jet ejector pump. The tangential connection of passages 18 and 20 into chamber 14 on opposite sides of the axis of chamber 14 is designed, in conjunction with the swirling mode of combustion, to provide a minimum pressure drop path for the recirculating gases exiting chamber 14 through passage 20. The recirculating gases are further drawn tangentially into vaporizing chamber 16, where they swirl down the chamber in the direction of air inlet 22. Oil is injected in atomized form into the stream of hot gases, the heat from which vaporizes the atomized oil before it has an opportunity to condense on the vaporizing chamber wall. Chamber 16 is kept below the temperature required to crack the hydrocarbon fuel (usually 900° F.) because the heat required to vaporize the liquid fuel comes from the hot gases, leaving them cooler, though chamber 16 stays above the fuel vaporization temperature (usually 600° F.). The suction described above draws the hot gases and vaporized oil from vaporizing chamber 16 into passage 18, where they are mixed with incoming air to produce a combustible mixture. Combustion is characterized by a blue flame, and is quiet and smoke-free. Fuel consumption is variable. One simply adjusts the amount of spray through nozzle 24*a* and air through nozzle 22*a* to obtain the desired rate of consumption within the permitted range. Fuel and air inputs can be stoichiometric, though excess air can be used.

In full operation as above described, passages 18 and 20 and vaporizing chamber 16 are all wide enough to provide, in conjunction with air inlet 22, a percent recirculation sufficient to maintain blue-flame combustion, which, with no excess input air, would be at least 50% under standard conditions, i.e., 1 atmosphere of pressure and 70° F., where percent recirculation R, is defined as follows:

$$R = \frac{\text{standard cfm of recirculated combustion products}}{\text{standard cfm of stoichiometric input air}} \times 100$$

The inner width of these parts, which together define the recirculation path, is large enough to lower the pressure drop caused by nozzle 22*a* and sustain this large amount of recirculation flow.

The concept of introducing the fuel at the inlet end of the vaporizing chamber, and into a gas stream acted upon by a vortex generator, was that solely of Andrew J. Syska, whose patent application is entitled "Recirculating Burner", and was filed Sept. 4, 1975, Ser. No. 610,250.

My most preferred embodiment makes use of a vortex generator at the recirculation chamber inlet, as disclosed in said Syska application, hereby incorporated herein by reference.

Other embodiments are within the following claims.

What is claimed is:

1. A burner for burning a vaporizable liquid fuel comprising:

a housing, a combustion chamber in said housing, said combustion chamber having an inlet and an outlet, a vaporizing chamber in said housing, said vaporizing chamber having an inlet and an outlet, a first passage interconnecting said combustion chamber inlet with said vaporizing chamber outlet, said first passage serving as a mixing chamber, a second passage interconnecting said combustion chamber toward said combustion chamber outlet with said vaporizing chamber inlet, for carrying hot combustion gases from said combustion chamber into said vaporizing chamber, a vaporizable liquid fuel inlet atomizer connected to said vaporizing chamber and positioned to direct atomized liquid fuel into said vaporizing chamber, for vaporization therein of said fuel by said hot combustion gases, said atomizer being effective to support vaporization of said fuel before the same touches a wall, an air inlet at the interface of said first passage and said vaporizing chamber outlet, positioned to direct air under pressure through said first passage and combustion chamber inlet into said combustion chamber, said second passage, said vaporizing chamber, and said first passage together defining a recirculation path for hot combustion gases from said combustion chamber back to said combustion chamber inlet, said path having sufficient width to provide in conjunction with said air inlet enough recirculation to maintain blue-flame combustion, said hot combustion gases being drawn by suction created by said air inlet into said vaporizing chamber and said vaporized fuel and hot gases being drawn by said suction into said first passage, where they are mixed with air entering from said air inlet to provide a combustible mixture, said mixture entering said combustion chamber through said combustion chamber inlet for burning in said combustion chamber, and said combustion chamber being cylindrical, said first passage entering said combustion chamber tangentially thereto through said combustion chamber inlet, said second passage connecting tangentially with said combustion chamber, said vaporizing chamber being cylindrical, said second passage entering said vaporizing chamber tangentially through said vaporizing chamber inlet, and said fuel inlet atomizer being directed into said cylindrical vaporizing chamber along the axis thereof.

2. The burner of claim 1 wherein said air inlet and said fuel inlet atomizer include nozzles

* * * * *